United States Patent [19]

Morini

[11] 3,984,030

[45] Oct. 5, 1976

[54] SINGLE ARTICLE DISPENSING MACHINE FROM A CONTINUOUS BAND-SHAPED PACKAGE OF THE SAME ARTICLES

[76] Inventor: Pier Domenico Morini, Viale Stelvio, 104, Busto Arsizio, Italy

[22] Filed: June 5, 1975

[21] Appl. No.: 584,030

[30] Foreign Application Priority Data

June 6, 1974 Italy ..... 23681/74

[52] U.S. Cl. ..... 221/30; 221/74; 221/210; 221/150 A; 214/1 BB; 99/357; 83/151; 83/277

[51] Int. Cl.[2] ..... G07F 11/72

[58] Field of Search ..... 221/70–72, 221/74, 26, 30, 210, 213–216, 220, 150 A; 83/151, 153, 154, 277, 268, 391; 214/1 BB; 99/357

[56] References Cited

UNITED STATES PATENTS

| | | | |
|---|---|---|---|
| 775,071 | 11/1904 | Townsend | 221/220 |
| 958,191 | 5/1910 | Stouder | 221/210 |
| 2,950,024 | 8/1960 | Adler | 221/150 A |
| 3,566,732 | 3/1971 | Hasten et al. | 221/71 |

FOREIGN PATENTS OR APPLICATIONS

| | | | |
|---|---|---|---|
| 1,474,777 | 5/1969 | Germany | 221/30 |

*Primary Examiner*—Robert B. Reeves
*Assistant Examiner*—H. Grant Skaggs
*Attorney, Agent, or Firm*—Kenyon & Kenyon Reilly Carr & Chapin

[57] ABSTRACT

Single product units are dispensed by a machine previously loaded with a band-shaped package thereof in a feeding station being a container. The first product unit of the band-package is positioned at a stop device, adjustable for a different size of the products, from which a caliper grips and draws the first unit to a cutting station, where a blade, co-operating with a backing blade severs the same from the band-package. The severed product unit passes through an aperture formed in a plate for supporting the blade and falls into a dispensing compartment. If it is the case, an oven is provided along the path of the single articles for heating or baking foodstuffs such as toasts and the like. Known timing devices and relay contacts are provided for the correct operation of the machine.

7 Claims, 4 Drawing Figures

SINGLE ARTICLE DISPENSING MACHINE FROM A CONTINUOUS BAND-SHAPED PACKAGE OF THE SAME ARTICLES

BACKGROUND OF THE INVENTION

This invention relates to a dispensing machine for sundry articles, from a band-package thereof.

The subject dispensing machine is of the type which operates by insertion of at least one coin or token. Machines of the above type are known, whereby it is possible to get foodstuffs, for example sandwiches, brioches, and products different from food, for example cigarette packages, books, stockings.

In this specification, the expression "product unit" means one of said products received by the insertion of at least one coin or token. In the machines already known in the art, the product units are packaged separately from each other. When the various stuffs in the machine are finished, i.e. when the machine has to be reloaded, the operator in charge of the machine must set the new product units almost one by one, because they are loose. This operation is time-consuming because of the retrieval of the empty machine.

Moreover it is known to put a single operator in charge of several dispensing machines, located in different places. Then the maintenance, usually performed daily, on such machines, becomes costly and time-consuming. It should also be noted that the product units are originally band-packaged.

In order to get single product units ready for delivery, by a dispensing machine, it is necessary to sever, by a cutter, the package at the location of the junction between each pair of units. This increases the manufacturing time of each product unit.

If the product units have to be dispensed hot, as is the case for toasts, the dispensing machine is provided with a separate baking oven coupled to it. Therefore, the withdrawal operation is rendered more difficult for the customer. The inconvenience is felt more deeply in that these machines are installed in places with a high number of customers.

The technical problem to be solved is that of reducing the maintenance time and of attaining the maximum ease of product units withdrawal.

SUMMARY OF THE INVENTION

It is the object of the present invention to provide a dispensing machine which solves the aforesaid technical problems by using directly the band-package of the product units to be delivered, always dispensing product units ready for use, or to be consumed.

According to a feature of the subject machine, it can be used for product units of different size, being provided with a device for adjustable forward motion.

The dispensing machine for sundry product units, of the type where each product unit is dispensed by inserting at least one coin or token, according to the invention is characterized by including: at least a feeding station for the product units in a band-package; a temporary stop device to hold the first product unit of the band-package; a guiding device for said first unit of the band-package, co-operating with the temporary stop device; a member for gripping and drawing the product units; control means for said grip and draw member to displace the product units along a first stroke being slightly larger than the length of a product unit; a cutting member, to sever from each other two adjacent product units, operable at the end of the first stroke; an ejection device for the product unit, operable at the end of the second stroke of the grip and draw member.

BRIEF DESCRIPTION OF THE DRAWINGS

The features of the machine according to the present invention, will be more apparent from the following description, provided as a non-limiting example, relating to the annexed drawings, in which.

DETAILED DESCRIPTION OF THE PREFERRED EMBODIMENT

Figure 1:
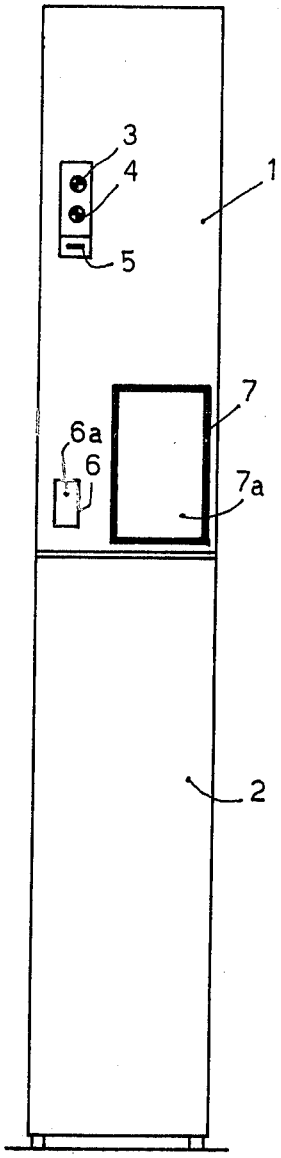
FIG. 1 is an outer front view of the dispensing machine of the invention.

Referring now more particularly to FIG. 1, the dispensing machine according to the invention is mainly comprised of two parts: a first part 1, provided in an upper position, bearing all the members for dispensing the product units, and a second part 2, provided at a lower position, and holding the band-shaped package of product units.

At first part 1 there is shown a pair of pilot lamps 3 and 4 which, in a known manner, indicate the operating conditions of the machine. There is provided a slot 5 for inserting a coin or a token in a known apparatus, not shown, to set the delivery operation.

At 6 there is shown a first window opening in a compartment 6*a* provided to receive the change when the coins or tokens which have been inserted exceed the cost of a product unit. At 7 there is shown a second window opening in a further dispensing compartment 7*a*, fed with a product unit on request by the customer.

Figure 2:
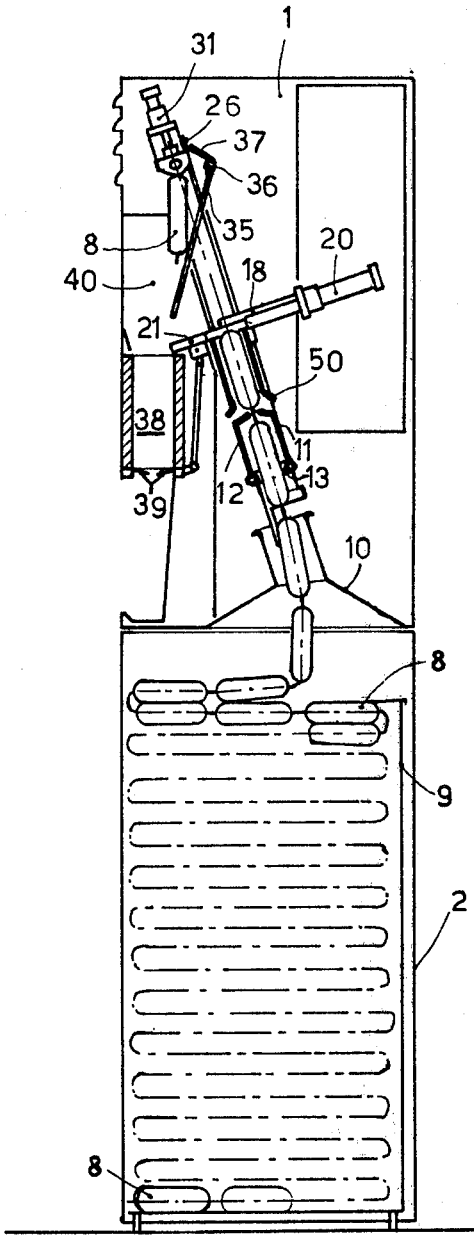
FIG. 2 is a diagrammatic elevational view in cross-section, of the dispensing machine of FIG. 1.
Figure 3:
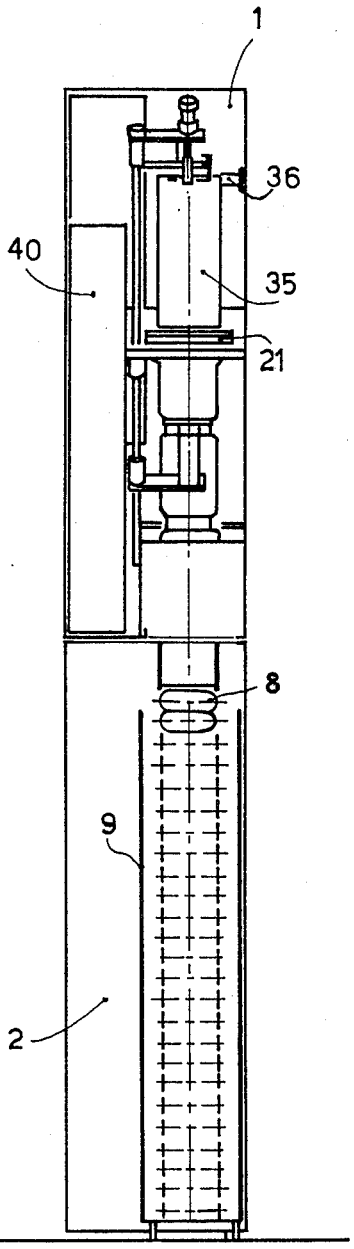
FIG. 3 is a front view of the inner side of the same dispensing machine.

Referring now more particularly to FIGS. 2 and 3, inside first part 1 are held all the members, hereinafter described, provided for delivering a product unit to the dispensing compartment 7*a*. Inside second part 2 are held all the product units, connected each other in a band-shaped package.

For sake of clarity, there is shown only the units at the leading end of the band-package, and the units at the trailing end, the band-package being otherwise shown in chain line.

Product units 8 packaged in a band-shape, are held in a feeding station by a container body 9 inside the second part 2 of the dispensing machine. Above the container body 9 there is provided a duct 10 for guiding the band package having a tapered cross-section, for an easier entry, in its first part, according to the direction of forward motion of the product units 8, and a constant cross-section in its second part. At the upper end of guide duct 10, there is provided a stop device, for the product units 8, immediately following the one which is being dispensed, and therefore located downstream of the stop device. The stop device is selectively disposed between first and second packages of the band-package to prevent a return of the first package into the guide duct 10.

More particularly, the latter stop device is a non-return device, provided on the aforesaid unit, to keep it in the arriving location. The stop device is comprised of two arms 11 and 12, each provided with an end pivoted on a support member 13, while the second end is bent inwardly of the duct defined by the arms, the product units 8 linearly moving one after the other through said duct.

The bent end of arms 11 and 12 are not in touch with each other in order to leave always enough room for passage of that part of the wrapping of the package connecting two adjacent product units 8.

The position of the stop device is provided fixedly, but said device is adjustable in order to allow the apparatus to be used for products of various length. To that end, the support member 13 is fixedly mounted on a sleeve 13*a*, slidable on a guide rod 14, fixedly mounted on the frame of the dispensing machine. In order to lock the sleeve 13*a* on the guide rod 14, there is provided a dowel or set screw (not shown). A limit stop 53 is provided for the displacement of sleeve 13*a* on guide rod 14.

The longitudinal central axis of rod 14 is parallel to the direction of forward motion of units 8. It should be noted that said axis is slanting to the vertical direction.

A piston and cylinder arrangement 15 (FIG. 4) controls the motion of a grip and draw member, hereinafter described. The piston and cylinder arrangement is operated by a station for fluid pressure control, by means of two ducts 16 and 17, to control the movement of the piston rod in either direction.

Downstream of the stop device, according to the moving direction of the product units 8, there is provided a cutter member, to sever a pair of product units 8 adjacent each other. Said cutter member is comprised of a blade 18 mounted at the end of a piston rod 19, having its cylinder 20 fixedly supported on the frame of the dispensing machine, with the longitudinal axis thereof perpendicular to the direction of forward motion of product units 8. Blade 18 is linearly displaceable over a plate 21, provided with an opening 22 allowing the product units 8 to pass therethrough.

A backing blade 23 is provided on plate 21, and co-operates with blade 18 for cutting the length of envelope connecting two adjacent product units.

Cylinder 20 is in communication with the fluid pressure control station, by two ducts 24 and 25, for the intake of fluid pressure. Upstream of the cutting member there is provided a guide (shown in FIG. 2 only) for product units 8, to position the same in registry with said cutter member. The guide is comprised of two parallel walls 50, fixedly mounted on the machine frame, with the end thereof bent for easier intake.

The aforesaid grip and draw member is comprised of a caliper 26, the jaws 27 and 28 thereof being substantially triangular in shape. At their adjacent apexes, they are pivotally mounted around pivots 29, connected to each other, in order that they are allowed to turn in opposite direction, to grip the length of wrapping of the first product unit or package 8 coming to them.

The direct turning control for the gripping operation, (jaw 27 turning counterclockwise while jaw 28 turns clockwise) and the reverse turning control for releasing, comes from a piston and cylinder arrangement with the cylinder 31 communicating to the fluid pressure station by a duct 33.

Rod 32 slidable inside cylinder 31, is pivoted at one end, by means of a fork member 34*a* to a pair of segments or shanckles 51, in turn pivotedly mounted at their other end to the jaws 27 and 28, by means of pivots 30. Caliper 26 is therefore similar to a wire-cutter, nevertheless it could have a different embodiment.

Figure 4:
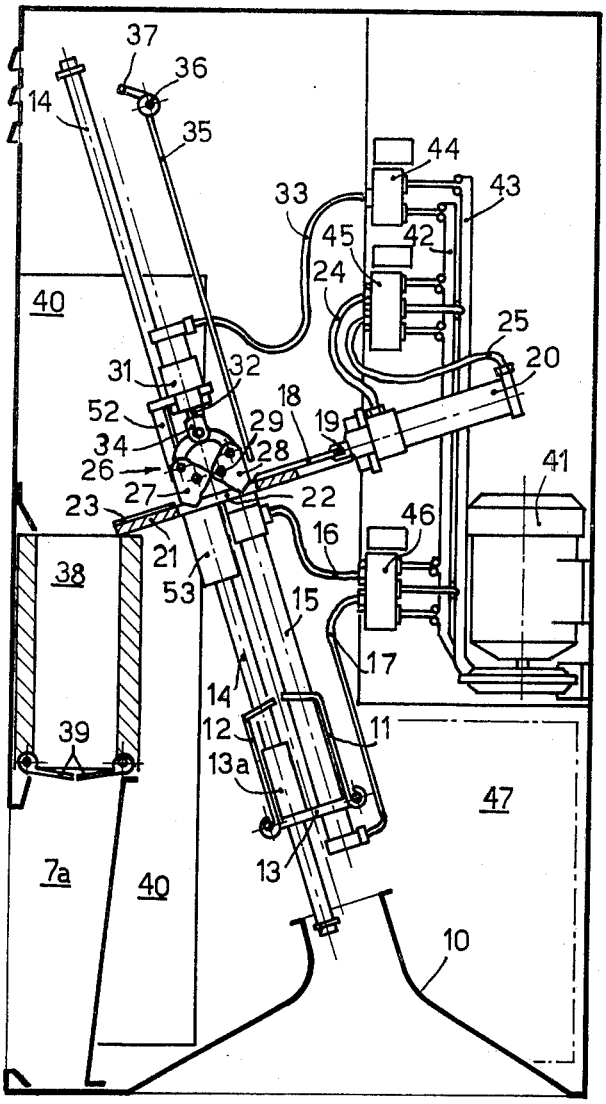
FIG. 4 is a detailed side view of the members provided to dispense a product unit.

Cylinder 31 is fixedly supported on piston rod 15 by means of a C-like segment 52, partially shown in FIG. 4, and provided with shaped parts (not shown), so that it is allowed to slide on guide rod 14.

The dispensing machine includes further an ejecting device disposed at an ejection station for ejecting the product units 8, being gripped by caliper 26 to the dispensing compartment 7*a*. The ejecting device is comprised of an arm 35, hinged at one end on a pivot 36.

As shown in FIG. 4, arm 35 is at rest and parallely positioned to the direction of linear motion of caliper 26, aside the path of the latter. As shown in FIG. 2, it is in working position, i.e. it is turned clockwise relating to the former position.

Pivoting of the arm 35 may be accomplished in any known way. As shown in FIG. 2 and 4, pivoting is performed by providing that once it has reached the end of its stroke, jaw 28 engages a prong 37, integral to the arm 35, overcoming temporarily the bias of a counteracting spring, for example a coil spring (not shown) inserted on pivot 36, acting to keep arm 35 in its rest position (FIG. 4).

A baking oven 38, known per se, is provided to receive any product unit 8 falling by gravity on arm 35. Oven 38 is provided, at the bottom, with a door 39, which opens timingly in a known way, being set on the baking time needed for the product to be dispensed.

Door 39 opens at its bottom on dispensing compartment 7*a*.

It is evident that, if the product units 8 do not need to be baked, the baking oven 38 should not be provided, and product units 8 would fall directly in the dispensing compartment 7*a*.

To that end, the body of oven 38 may be made removable from the frame of the dispensing machine.

At 40 there is shown, for explanation only, the position of a container for a token-operated apparatus, known per se and therefore not described.

The aforesaid fluid pressure control station includes a motor 41 acting on a pump, not shown, which feeds a pair of delivery ducts 42 and 43. Through known valve means 44, 45, 46 the pressurized fluid, preferably water, is sent to ducts 33, 24, 25, 16, 17.

An electric control station (not shown) in association with the fluid pressure control station. The electric control station includes a plurality of relay contacts, or the like, which control the various piston and cylinder assemblies, acting in a known way on the valve means 44, 45, 46.

The number of such contacts and the function thereof, will become more apparent from the description given hereinafter, of the operation of the dispensing machine.

At a lower position than the fluid pressure control station, there is provided a compartment where a refrigerator assembly 47 is housed, shown in chain lines.

Refrigerator assembly 47 is provided for either case of foodstuffs like sandwiches, brioches or the like, in order to keep them; or in the case of deep-frozen foodstuffs, in order to keep them at the needed proeservation temperature. In the latter case, the power of the assembly must of course be larger.

The dispensing machine hereinabove described is provided to dispense hot products. If toasts have to be handled, the baking oven 38 may be provided with a piston (not shown) to put the needed pressure on their faces during baking time.

It is possible to use a plurality of dispensing machines together, of the type hereinbefore described, with a single token-operated apparatus. In such a case, the floor space required is less and it is possible to install a smoke-suction plant as well, if the dispensing machines with the oven in operation are more than one.

It is further possible to use together dispensing machines for different products, setting them selectively, according to the products to be dispensed, i.e. providing or not the baking oven, using a refrigerator assembly of a given power, controlling the stroke of the draw members.

In the dispensing machine of this invention, there is also a provision for an electric device to control the correct operation. Such devices are not shown, because they are per se known.

Said devices are provided in order that the machine can repeat the operations not previously completed because of a malfunction, or a temporary failure of electric power.

The operation of the dispensing machine according to the present invention is as follows (FIGS. 2, 3 and 4).

Having inserted the full container body 9 inside the second part 2 of the machine, the operator pulls on the first product unit 8, introducing it between the two walls 50, and allowing it to bear on the stop device formed by the two arms 11, 12. The machine is thus ready for use.

It should be noted how fast and ready is the charging operation of the machine. The user inserts a coin or token in the slot 5, operating the machine.

The caliper 26, controlled by rod 32, closes its jaws 27, 28 on the outer edge of the band-shaped package of product units 8. At this point, a first contact controls the operation of piston 15 and the linear motion of caliper 26 away from the stop device along guide rod 14. A second contact makes the caliper 26 stop temporarily when the part of the package connecting a unit 8 being gripped, to the adjacent one, is in front of the window 22.

A third contact, or an auxiliary contact for the second contact, controls the operation of rod 19 bearing the blade 18. There is now a product unit 8 gripped by the caliper 26 and severed from the band-package.

A fourth contact controls again the operation of piston 15 and therefore the displacement of caliper 26 on guide rod 14. Above the latter, a fifth contact is provided, which makes it stop when it enters into engagement with segment 37 of arm 35, which is rotated in a working position. Fifth contact controls as well the starting of operation of baking oven 38.

An auxiliary contact for the fifth contact, delayed from the former, controls the operation of rod 32 of cylinder 31, and then the opening of caliper 26.

The product unit 8 falls in oven 38 and, after baking, it is discharged in the dispensing compartment 7*a* through door 39.

A sixth contact controls the back stroke of caliper 26, towards the starting position; arm 35 goes back to the rest position.

The machine is now ready to dispense a new product unit.

For different products, the operation described is still valid provided that the unnecessary contacts are eliminated, as for example the contact controlling the operation of baking oven 38.

The advantages of the dispensing machine of this invention are mainly the following:

1. loading is fast;
2. it is possible to use different products, of different sizes;

3. it is possible to use directly the band-package of the product units.

Those skilled in the art may of course effect some changes or additions to the described embodiment, without departing from the scope of the invention, as defined by the appended claims.

What I claim is:

1. A dispensing machine for units of various products of the type where each product unit is dispensed by the insertion of at least a coin or a token, which comprises a feeding station for the product units in a bandpackage; a temporary stop device to hold the first product unit of the band-package, said stop device being adjustably positioned according to the size of relative to a product units; means for guiding said first product unit said means for guiding cooperating with the temporary stop device; to hold the first product unit a grip and draw member for the product units; control means for said grip and draw member to displace a single product units along a first and a second stroke, one after the other, said first stroke being slightly larger than the length of a product unit; a cutting means to sever two adjacent product units from each other operable at the end of the first stroke; and an ejection device for discharging the product units operable at the end of the second stroke of the grip and draw member.

2. The dispensing machine of claim 1, further comprising a baking station.

3. The dispensing machine of claim 1, wherein the cutter means includes a plate transversely mounted to the direction of motion of the product units, and provided with an opening through which the product units can pass in their forward motion, on the plate there being provided a blade linearly moving, and co-operating with a backing blade projecting into said opening.

4. The dispensing machine of claim 1, wherein each feeding station is a container removable from the body of the machine.

5. The dispensing machine of claim 1, wherein the stop device comprises two arms opening in the direction of forward motion of the product units, and mounted on a support adapted to be clamped on a rod fixedly mounted on the frame of the machine, in predetermined positions.

6. The dispensing machine of claim 1, wherein the ejection device comprises a rotatable arm, operated by said grip and draw member.

7. A dispensing machine for dispensing packages from a band-package comprising a guide duct for guiding the packages of the band package linearly therethrough;

a stop device at an upper end of said guide duct for selective disposition between first and second packages of the band-package to prevent a return of the first package into said guide duct, said stop device being adjustably mounted relative to said guide duct;

a grip and draw member for gripping a first package of the band-package downstream of said stop device, a cutter member for severing the first package from the band package;

an injecting device disposed at an ejection station for ejecting a severed first package into a dispensing compartment; and means for moving said grip and draw member relative to said stop device in a sequence in which a gripped package is first moved past said cutter member, thereafter stopped while said cutter member severs the first package from the band-package, and thereafter moved to said ejection station for ejection into said dispensing compartment.

* * * * *

UNITED STATES PATENT AND TRADEMARK OFFICE

CERTIFICATE OF CORRECTION

PATENT NO. : 3,984,030

DATED : October 5, 1976

INVENTOR(S) : PIER DOMENICO MORINI

It is certified that error appears in the above-identified patent and that said Letters Patent are hereby corrected as shown below:

Column 2, line 64, delete "latter".

Claim 1, line 7, after "size of" delete --relative to a-- and insert --the product units relative to a means--.

Claim 1, line 8, delete "product units; means".

Claim 1, line 12, delete "a".

Signed and Sealed this

Eighteenth Day of January 1977

[SEAL]

*Attest:*

RUTH C. MASON
*Attesting Officer*

C. MARSHALL DANN
*Commissioner of Patents and Trademarks*